United States Patent [19]

Nakamura et al.

[11] Patent Number: 4,977,882

[45] Date of Patent: Dec. 18, 1990

[54] DISTRIBUTOR TYPE FUEL INJECTION PUMP

[75] Inventors: Hisashi Nakamura; Ken-ichi Kubo; Toshiro Hirakawa, all of Saitama, Japan

[73] Assignee: Diesel KIKI Co., Ltd., Tokyo, Japan

[21] Appl. No.: 396,984

[22] Filed: Aug. 22, 1989

[51] Int. Cl.[5] ..... F02M 39/00

[52] U.S. Cl. ..... 123/502; 123/449

[58] Field of Search ..... 123/502, 449, 450; 417/462

[56] References Cited

U.S. PATENT DOCUMENTS

| | | | |
|---|---|---|---|
| 4,327,696 | 5/1982 | Kobayashi et al. | 123/449 |
| 4,432,327 | 2/1984 | Salzgeber | 123/502 |
| 4,495,916 | 1/1985 | Shinoda | 123/449 |
| 4,534,332 | 8/1985 | Eheim | 123/502 |
| 4,593,669 | 6/1986 | Igarashi | 123/502 |
| 4,733,645 | 3/1988 | Hain | 123/502 |
| 4,753,211 | 6/1988 | Hofer | 123/502 |
| 4,798,189 | 1/1989 | Thornthwaite | 123/502 |
| 4,873,956 | 10/1989 | Fehlmann et al. | 123/449 |

*Primary Examiner*—Carl Stuart Miller
*Attorney, Agent, or Firm*—Henry C. Nields

[57] ABSTRACT

A fuel injection pump of the type wherein the fuel injection timing is controlled by a timer and a solenoid-operated timing control valve. The timer has a high-pressure chamber and a low-pressure chamber which are defined at both sides, respectively, of a timer piston. The high-pressure chamber communicates with a high-pressure groove formed in the timing control valve through a passage. The low-pressure chamber communicates with the suction side of a feed pump through a low-pressure passage and also communicates with a low-pressure hole formed in the timing control valve through a passage. The timer piston is not provided with a passage mechanism which provides communication between a pump chamber and the high-pressure chamber. The pump chamber communicates directly with the high-pressure groove in the timing control valve through a fixed orifice disposed in the wall of the pump housing and a passage leading to the orifice. This structure enables a reduction in the dead volume of the passage required to activate the timer piston.

10 Claims, 5 Drawing Sheets

DISTRIBUTOR TYPE FUEL INJECTION PUMP

BACKGROUND OF THE INVENTION

1. Field of the Invention

The present invention relates to a distributor type fuel injection pump. More particularly, the present invention pertains to a distributor type fuel injection pump which is designed so that the injection timing is controlled electronically.

2. Description of the Prior Art

Japanese Patent Application Laid-Open Publication (KOKAI) No. 57-97024 (1983) discloses a distributor type fuel injection pump for use in a diesel engine wherein a timer piston is moved in response to the operation of a timing control valve which is subjected to duty control, thereby controlling the injection timing.

In this type of timer, as shown in FIG. 10, a timer piston chamber 2*a* is formed in a housing and a timer piston 2*b* is slidably inserted into the timer piston chamber 2*a* so as to partition it into a high-pressure chamber 20 and a low-pressure chamber 21 which are defined at both sides thereof. In addition, a solenoid-operated timing control valve 3 is attached to an end portion of the housing. The high-pressure chamber 20 is communicated with a pump chamber 9 through an orifice 200 and a port 201 which are bored in the timer piston 2*b*, and a side portion of the high-pressure chamber 20 is communicated with a high-pressure groove 30 in the timing control valve 3 through a port 300. A spring 2*d* is disposed in the low-pressure chamber 21 to constantly bias the timer piston 2*b* toward the high-pressure chamber 20. The low-pressure chamber 21 is communicated with a low-pressure hole 31 in the timing control valve 3 through a passage 32.

In this prior art, a timer piston control oil-hydraulic path is formed with respect to the pump chamber pressure Pt with the orifice 200 bored in the timer piston 2*b* defined as a boundary, as shown in FIG. 11, so that the fuel oil in the pump chamber.9 flows into the high-pressure groove 30 in the timing control valve 2 through the orifice 200 in the timer piston 2*b*, the port 201, the high-pressure chamber 20 and the port 300.

In the above-described oil-hydraulic path, it may be considered that the orifice 200 cuts off a portion of the pump chamber 9. It is clear that the smaller the dead volume of the cut-off portion, the better the timing control performance. As the conventional oil-hydraulic path is viewed dynamically, the pressure that actually activates the timer piston 2*b* is that in the high-pressure chamber 20 and therefore the dead volume $V_2$ increases by an amount corresponding to the ports 201 and 300, resulting in an increase in the work done by the timing control valve 3 to change the pressure $Pt_2$ in the high-pressure chamber 20 through leak control. In other words, the amount of work required to change the level of working pressure acting on the timer piston 2*b* increases and the response of the timer pistion 2*b* to the injection timing control lowers.

SUMMARY OF THE INVENTION

It is a primary object of the present invention to provide a distributor type fuel injection pump which is designed so that the dead volume of a timer control oil-hydraulic path is reduced with a relatively simple structure, thereby improving the responsiveness of the timer piston, and thus improving the injection timing control performance.

To this end, the present invention provides a fuel injection pump of the type having an oil-hydraulic timer which causes a roller holder assembly giving an axial reciprocating motion to a plunger to move either in the advancing direction or in the retarding direction and a solenoid-operated timing control valve which causes the high- and low-pressure chambers defined in the timer to be communicated with or cut off from each other, wherein a pump chamber formed in a pump housing is connected directly to a high-pressure groove formed in the solenoid-operated timing control valve through a passage including a fixed orifice provided in the pump housing.

More specifically, the present invention provides a distributor type fuel injection pump comprising:

a. a pump housing having a hollow body, a cover covering an upper opening in the body, and a distributor head closing a side opening in the body;

b. a pump chamber formed in the pump housing;

c. a plunger barrel rigidly secured to the distributor head in such a manner that one end of the plunger barrel faces the pump chamber, the plunger barrel having a feed passage for leading fuel from the pump chamber and a plurality of outlet ports which are out of phase with the feed passage, the outlet ports communicating with a delivery valve attached to the distributor head;

d. a feed pump driven by a driving shaft extending through that portion of the body on the side thereof which is remote from the plunger barrel to feed fuel to the pump chamber;

e. a plunger inserted into the plunger barrel, one end of the plunger cooperating with the plunger barrel to define a fuel pressurizing chamber, the other end of the plunger being coupled to the driving shaft in such a manner that the plunger is rotatable together with the driving shaft in one unit and also reciprocatable axially, the plunger having an outlet slit for providing communication between one of the outlet ports and the fuel pressurizing chamber during the first half of the reciprocating stroke of the plunger, and an inlet slit for providing communication between the feed passage and the fuel pressurizing chamber during the second half of the reciprocating stroke;

f. a cam mechanism for giving axial reciprocating motion to the plunger, the cam mechanism having a disk cam rotating together with the plunger in one unit, a roller holder assembly having a plurality of rollers supporting the disk cam, and a spring assembly pressing the cam disk;

g. a timer disposed in the lower part of the body to rotate the roller holder assembly in order to control the fuel injection timing, the timer having a cylindrical timer piston chamber and a timer piston dividing the interior of the timer piston chamber into a high-pressure chamber and a low-pressure chamber, the timer piston being coupled to the roller holder assembly through a pin;

h. a solenoid-operated timing control valve disposed in the vicinity of the timer to cause the high-pressure chamber and the low-pressure chamber to be communicated with or cut off from each other, thereby controlling the level of pressure inside the high-pressure chamber;

i. the low-pressure chamber in the timer communicating with a low-pressure hole in the timing control valve through a first passage;

j. the high-pressure groove in the solenoid-operated timing control valve communicating with the high-pressure chamber through a second passage; and k. the high-pressure groove and the pump chamber being directly connected together by a third passage through a fixed orifice located in the wall of the body.

The present invention is applicable not only to a distributor type fuel injection pump wherein the pump chamber is constituted by the whole internal space in the pump housing including the cam mechanism disposing region but also to a distributor type fuel injection pump wherein the pump chamber is constituted by a part of the internal space in the pump housing.

More specifically, the arrangement may be such that the pump chamber is annularly defined between the inner wall of the body, the end face of the distributor head and a spring seat constituting the plunger spring assembly, the interior of the body other than the annular pump chamber is defined as a cam chamber accommodating a lubricating oil, and the annular pump chamber is fed with fuel from the feed pump through a fuel feed passage which by-passes the cam chamber.

It is preferable that the fuel feed passage has a radial passage extending radially of the body so as to lead to a discharge port of the feed pump and a pair of first and second bent passages bored in the cover, one end of the second bent passage leading to a fuel reservoir defined between the cover and a recess provided in the upper part of the body, and the fuel reservoir communicating with the annular pump chamber through a bore provided with a filter.

The fixed orifice may be constituted by a bore having a small diameter which is formed directly in the wall of the pump housing or may be formed by fitting a chip having a small-diameter bore into a hole formed in the wall of the pump housing.

According to the present invention, the fuel oil in the pump chamber flows directly to the high-pressure groove in the timing control valve from the fixed orifice in the bottom of the body through the passage, whereas in the prior art the fuel oil flows to the high-pressure groove from the upper opening in the timer piston chamber through an orifice and port formed in the timer piston and the high-pressure chamber in the timer piston chamber.

When the solenoid unit of the timing control valve is energized, the needle is lifted to open the valve, thus bringing the high-pressure groove into communication with the low-pressure hole. As a result, the pressure in the high-pressure chamber of the timer is leaked to the low-pressure chamber, resulting in a lowering in the pressure inside the high-pressure chamber. Thus, the timer piston is set at a position where the adjusted pressure and the force from the spring balance with each other. Accordingly, the angular position of the roller holder assembly is adjusted by ON/OFF controlling the supply of electric power to the solenoid unit in a desired duty ratio with the electronic controller, thus enabling the injection timing to be changed as desired.

In such a control, the working pressure that actually activates the timer piston is the pressure inside the high-pressure chamber. In the present invention, the oil-hydraulic path that extends from the pump chamber to the high-pressure chamber comprises the pump chamber, the fixed orifice in the pump housing, the third passage, the high-pressure groove and the second passage. Therefore, the dynamic dead volume that exists between the fixed orifice and the valve seat portion (the boundary between the high- and low-pressure regions) of the timing control valve is reduced. As a result, the amount of work required to change the level of working pressure acting on the timer piston is reduced correspondingly. It is therefore possible to improve the responsiveness of the timer piston and hence realize fuel injection timing control which is appropriate for each particular engine rotating condition.

If the pump chamber is partitioned off from the cam chamber, the cam chamber can accommodate a lubricating oil independently of the fuel. Therefore, it is possible to prevent peeling of the surface portions of the cam mechanism which would otherwise occur when a fuel is misused and avoid a trouble caused by the peeling as well as obtain the aforementioned advantages.

The above and other objects, features and advantages of the present invention will become more apparent from the following description of the preferred embodiments thereof, taken in conjunction with the accompanying drawings.

DETAILED DESCRIPTION OF THE PREFERRED EMBODIMENTS OF THE INVENTION

Figure 1:
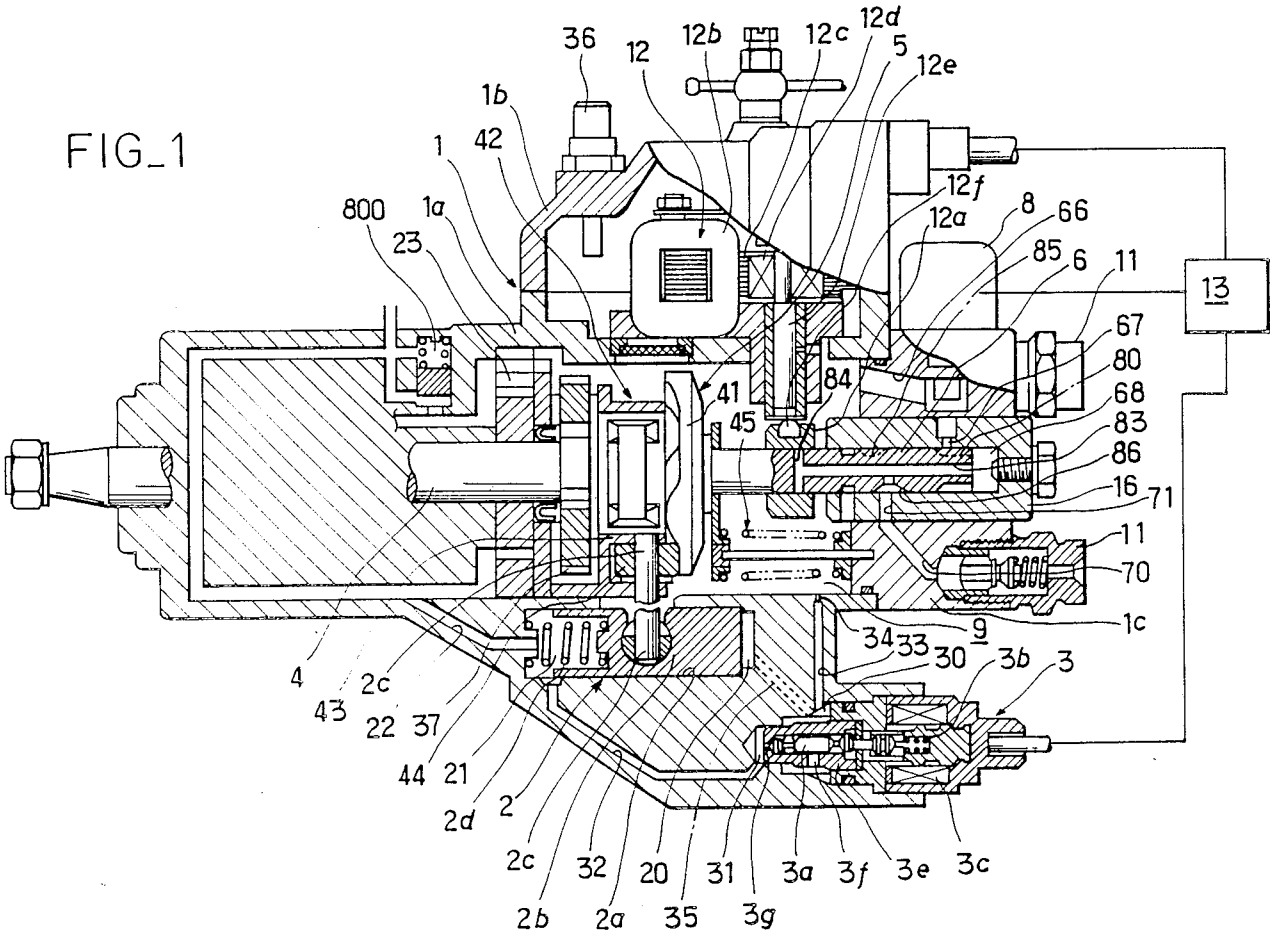
FIG. 1 is a partially-sectioned side view showing a first embodiment of the distributor type fuel injection pump according to the present invention.
Figure 2:
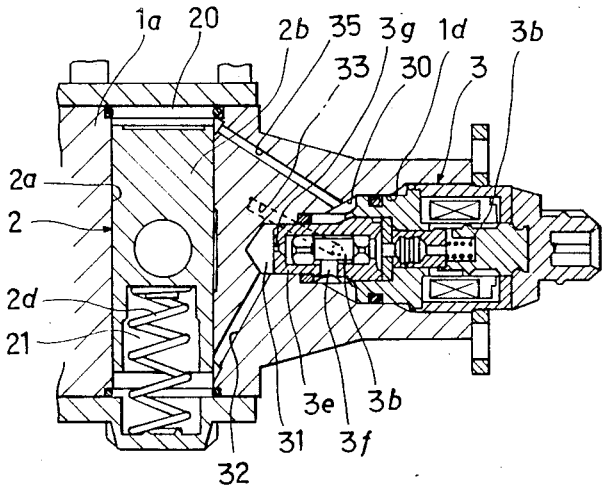
FIG. 2 is a sectional view of the lower part of the body shown in FIG. 1.

FIGS. 1 and 2 show in combination a first embodiment of the present invention. Referring first to FIG. 1, the reference numeral 1 denotes a pump housing which has a hollow body 1*a*, a cover 1*b* which is rigidly secured to the body 1*a* so as to cover an upper opening in the body 1*a*, and a distributor head 1*c* which closes an opening provided at the right-hand end of the body 1*a*. An internal region that is surrounded by these members is defined as a pump chamber 9. The interior of the cover 1*b* is communicated with the pump chamber 9 through a filter.

The reference numeral 4 denotes a driving shaft. The driving shaft 4 is inserted into the pump chamber 9 from the left end side of the body 1*a*. That portion of the driving shaft 4 which projects outward from the body 1*a* is coupled to the crankshaft of a diesel engine through a reduction gear or the like (not shown) so that the shaft 4 is driven by the diesel engine. A feed pump 23 is disposed in the left end portion of the pump chamber 9 so as to be coaxial with the driving shaft 4. The feed pump 23 supplies fuel oil introduced thereto from an external pump into the pump chamber 9 through a regulating valve 800. The regulating valve 800 functions as a means for minimizing the change in pressure inside the pump chamber 9 within the normal rotational speed range.

The reference numeral 6 denotes a plunger which is slidably received in a plunger barrel 16 which is rigidly fitted into the distributor head 1*c* so as to be coaxial with the driving shaft 4. A fuel pressurizing chamber 68 is defined between the top surface of the plunger 6 and the plunger barrel 16. In the case where the plunger barrel 16 is constituted by a cylinder both ends of which are open, as shown in a third embodiment (described later) of the present invention, the fuel pressurizing chamber 68 is defined between the top surface of the plunger 6 and a head plug 17 which is screwed into the distributor head 1*c* so as to be in close contact with the top of the plunger barrel 16.

The left end portion of the plunger 6 is coupled to the right end portion of the driving shaft 4 through a cam mechanism 5 so that the plunger 6 is rotatable in response to the rotation of the driving shaft 4 and also capable of reciprocating axially. The cam mechanism 5 comprises a cam disk 41 coupled to the plunger 6 through a pin, a roller holder assembly 42 having a plurality of rollers 44 supporting the cam disk 41, and a spring assembly 45 which biases the cam disk 41 so that the cam surface is forced into contact with the rollers 44. The cam mechanism 5 will be described in detail in connection with the third embodiment of the present invention.

The plunger 6 has a plurality of inlet slits 80 provided in the outer periphery of the end portion thereof, the number of inlet slits 80 corresponding to the number of engine cylinders. The plunger 6 is further provided with a center hole 83 which extends axially from the top surface thereof. The left (as viewed in the figure) end of the center hole 83 opens to define a cut-off port 84 at a position beyond the region that is surrounded by the plunger barrel 16. The cut-off port 84 is selectively opened or closed by a control sleeve 12*a* which is slidably fitted on the plunger 6 as described later, thereby controlling the fuel injection quantity. In addition, a single outlet slit 86 is provided in the outer periphery of the intermediate portion of the plunger 6, the outlet slit 86 being communicated with the intermediate portion of the center hole 83 through a by-pass, and a pressure equalizing slit 85 is provided at a position which is offset from the outlet slit 86 in the circumferential direction.

When the fuel pressurizing chamber 68 coincides with an inlet port 67 provided in the plunger barrel 16 during the descending stroke of the plunger 6 that is caused by the cam disk 41 and a plunger spring, fuel oil is sucked into the fuel pressurizing chamber 68 from a feed passage 66 which leads to the pump chamber 9. At the same time, the center hole 83 is also filled with the fuel oil. During the injection stroke that the plunger 6 rotates while ascending, the fuel is pressurized, and when the outlet slit 86 comes to a position facing one of the outlet ports 71 provided in the plunger barrel 16, the number of outlet ports 71 corresponding to the number of engine cylinders, the pressurized fuel is supplied to an injection nozzle (not shown) from a discharge passage 70 through a delivery valve 11. When the plunger 6 rotates 180 degrees after the completion of the injection, the outlet port 71 coincides with the pressure equalizing slit 85, thereby bringing the discharge passage 70 into communication with the pump chamber 9, and thus causing the fuel pressure inside the discharge passage 70 to lower to the same level as the pressure inside the pump chamber 9.

It should be noted that a solenoid valve 8 for cutting off the supply of fuel is provided in the intermediate portion of the feed passage 66 to close the feed passage 66 when the engine is stopped.

The control sleeve 12*a* is controlled by an electric governor 12 which is disposed inside the cover 1*b*. More specifically, the electric governor 12 has a coil 12*b*, a core 12*c* and a rotor 12*d* which is coupled to the control sleeve 12*a* through a shaft 12*e* and a ball 12*f*. Accordingly, the position of the control sleeve 12*a* is controlled by a change in the angle of rotation of the rotor 12*d* which is caused by the control of the supply of electric power to the coil 12*b*, thus causing a change in the effective stroke of the plunger 6.

An oil-hydraulic timer 2 is provided in the lower part of the body 1*a* to serve as a means for controlling the injection timing. The timer 2 has a cylindrical timer piston chamber 2*a* and a timer piston 2*b* slidably received therein. The intermediate portion of the timer piston 2*b* is coupled to the holder 43 of the roller holder assembly 42 through a pin 2*c*.

The left end portion of the timer piston chamber 2*a* is defined as a low-pressure chamber 21 provided with a spring 2*d* which biases the timer piston 2*b* horizontally as viewed in FIG. 1. The low-pressure chamber 21 is connected to the suction side of the feed pump 23 through a low-pressure passage 22. The right end portion of the timer piston chamber 2*a* is defined as a high-pressure chamber 20. It should be noted that the timer 2 is shown in a 90°-developed state in FIG. 1 due to the convenience of explanation. Actually, the axes of the timer piston chamber 2*a* and the timer piston 2*b* extend perpendicular to the surface of the drawing. FIG. 2 shows the actual state of the timer 2. In FIG. 2, illustration of coupling means such as a pin is omitted.

Referring to FIGS. 1 and 2, the reference numeral 3 denotes a solenoid-operated timing control valve which cooperates with the timer 2 to switch the flow of oil pressure to the timer piston 2*b*, thereby controlling the movement of the timer piston 2*b*, and thus varying the fuel injection timing. The timing control valve 3 in this embodiment comprises a valve body 3*e* which is fitted in a hole 1*d* provided in the lower part of the body la and which has a side bore 3*f* and an end bore 3*g*, a needle 3*a* slidably disposed inside the valve body 3*e*, a spring 3*b* which biases the needle 3*a* so as to close the end bore 3*g*, and a solenoid unit 3*c* which is energized to move the needle 3*a* so as to open the end bore 3*g* against the spring 3*b*.

The hole 1*d* that has the timing control valve 3 fitted therein has a high-pressure groove 30 provided in an intermediate portion corresponding to the side bore 3*f* and a low-pressure hole 31 formed in a portion corresponding to the end bore 3*g*. The high-pressure groove 30 is communicated with the high-pressure chamber 20 in the timer piston chamber 2*a* through a passage 35, while the low-pressure hole 31 is communicated with the low-pressure chamber 21 in the timer piston chamber 2a through a passage 2.

The solenoid unit 3c is connected to an electronic controller 13 through a connector and a cord. The electronic controller 13 gives an instruction on the basis of signals from a load sensor, an engine speed sensor (sensing gear plate) 37, a fuel temperature sensor 36, etc., and the solenoid unit 3c is activated in a desired duty ratio according to the instruction. It should be noted that the electronic controller 13 is also electrically connected to the electric governor 12 and the cut-off solenoid 8 to control the operations thereof.

In the prior art, the pump chamber 9 and the timer piston high-pressure chamber 20 have heretofore been communicated with each other through an orifice and port which are bored in the timer piston 2b itself. In other words, the pump chamber 9 and the high-pressure groove 30 in the timing control valve 3 are communicated with each other via the timer piston 2b.

The feature of the present invention resides in that the pump chamber 9 and the high pressure groove 30 in the timing control valve 3 are communicated with each other directly through a passage 33 extending through the pump housing 1 without employing any orifice nor port. In addition, a fixed orifice 34 is provided in a part of the passage 33 for minimizing the effect of the pulsation of the control oil pressure (the oil pressure in the pump chamber 9) on the high-pressure groove 30.

It is preferable to provide the fixed orifice 34 in the bottom of the body la from the viewpoint of machining. A specific form of the fixed orifice 34 will be described later. It should be noted that the junction of the passage 33 and the high-pressure groove 30 is located at a position which is circumferentially offset from the junction of the passage 35 and the timer pistion high-pressure chamber 20.

Figure 3:
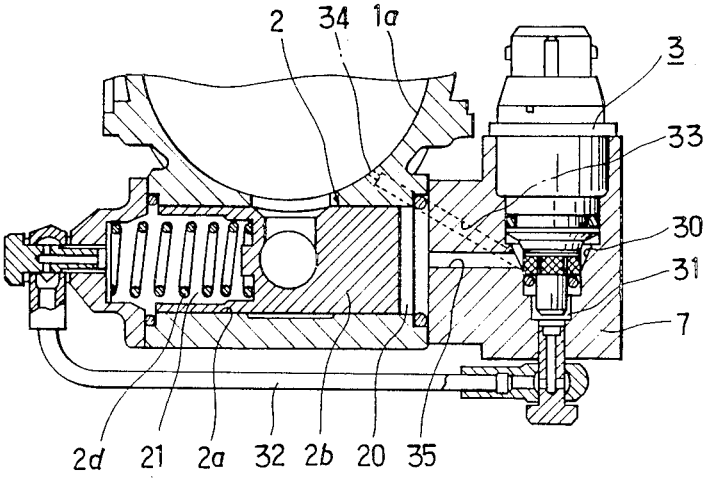
FIG. 3 is a fragmentary sectional view showing a second embodiment of the present invention.

FIG. 3 shows a second embodiment of the present invention. In this embodiment, the timing control valve 3 is attached to a block 7 for a valve holder which is provided separately from the body 1a, the block 7 being connected to the body 1a by means of a bolt (not shown). Accordingly, the hole 1d, the high-pressure groove 30 and the low-pressure hole 31 in this embodiment are provided in the block 7. The passage 33 is provided so as to extend from the body 1a to the block 7, while the passage 35 is bored in the block 7. The low-pressure passage 32 in this embodiment is formed by use of an external pipe. This arrangement is, however, not necessarily exclusive and it is, as a matter of course, possible to form an internal passage serving as the low-pressure passage 32.

Figure 4A:
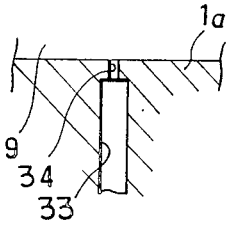
FIGS. 4*a* to 4*c* are sectional views respectively showing different forms of the fixed orifice employed in the present invention.
Figure 4B:
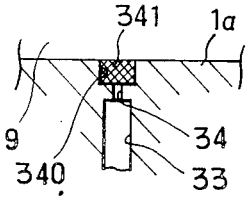
Figure 4C:
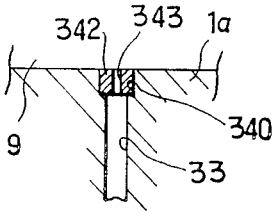

FIGS. 4a, 4b and 4c show three different forms, respectively, of the fixed orifice 34 which may be applied to the first and second embodiments and also to a third embodiment described later. FIG. 4a shows an orifice 34 constituted by a bore having a small diameter which is formed in the bottom wall of the body 1a. FIG. 4b shows an arrangement wherein a stepped hole 340 is formed in the bottom wall of the body 1a, a small-diameter bore is formed in the bottom of the hole 340, and then a filter 341 is fitted into the hole 340. FIG. 4c shows another arrangement wherein a chip 342 having a small-diameter bore 343 is formed separately and rigidly fitted into a stepped hole 340 formed in the bottom wall of the body 1a by means, for example, of press fitting or screwing.

FIGS. 5 to 8 show in combination a third embodiment of the present invention.

Unlike the first and second embodiments wherein the pump chamber 9 is formed so as to extend over the whole space inside the body 1a, this embodiment has an annular pump chamber 9 which is defined by a certain divisional area (the other internal area accommodating a lubricating oil). The present invention is also applicable to this type of distributor type fuel injection pump. In this embodiment, the bottom of the annular pump chamber 9 is connected directly to the high-pressure groove 30 in the timing control valve 3 through a passage 33 having a fixed orifice 34.

This embodiment has the merit that the cam mechanism 5 is effectively lubricated even when a user who does not know that fuel (gas oil) also serves as a lubricating oil employs a light-duty oil such as kerosene in place of a gas oil. More specifically, if a light-duty oil is mistakenly put in the housing 1, the cam mechanism 5 is not satisfactorily lubricated, which results in peeling of the surfaces of the rollers and the disk cam which are strongly contacted by each other by means of the force from the spring. There is therefore a fear that chips resulting from the peeling will interfere with the movement of the mechanism inside the body 1a. Such a problem can be solved by this embodiment.

A great difference between the third and first embodiments resides in that an annular pump chamber 9 and a cam chamber 14 are defined inside the body la by making use of the spring assembly 45 of the cam mechanism 5 and the cam chamber 14 is filled with a lubricating oil, while the annular pump chamber 9 is supplied with fuel from the feed pump 23 through a passage which by-passes the cam chamber 14.

Figure 7:
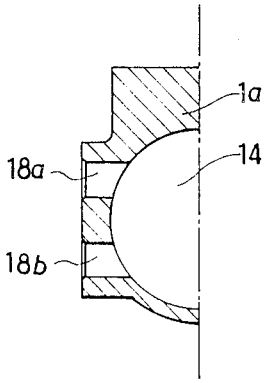
FIG. 7 is a fragmentary sectional view showing the lubricating oil inlet/outlet section in the third embodiment.

More specifically, the feed pump 23 is partitioned off from the cam chamber 14 by a shielding plate 25. The cam chamber 14 is provided with an inlet port 18a and an outlet port 18b, as shown in FIG. 7, and an engine oil circulating system is connected to the ports 18a and 18b through eye bolts (not shown).

On the other hand, that portion of the body 1a which is leftward of the feed pump 23 is provided with a suction passage 24 and a suction port 23a so that fuel is supplied to the feed pump 23 from an external fuel pump through the suction passage 24 and the suction port 23a. The discharge port 23b of the feed pump 23 is connected to the annular pump chamber 9 through a fuel supply passage 60 which is formed so as to extend over from the body 1a to the cover 1b.

Figure 5:
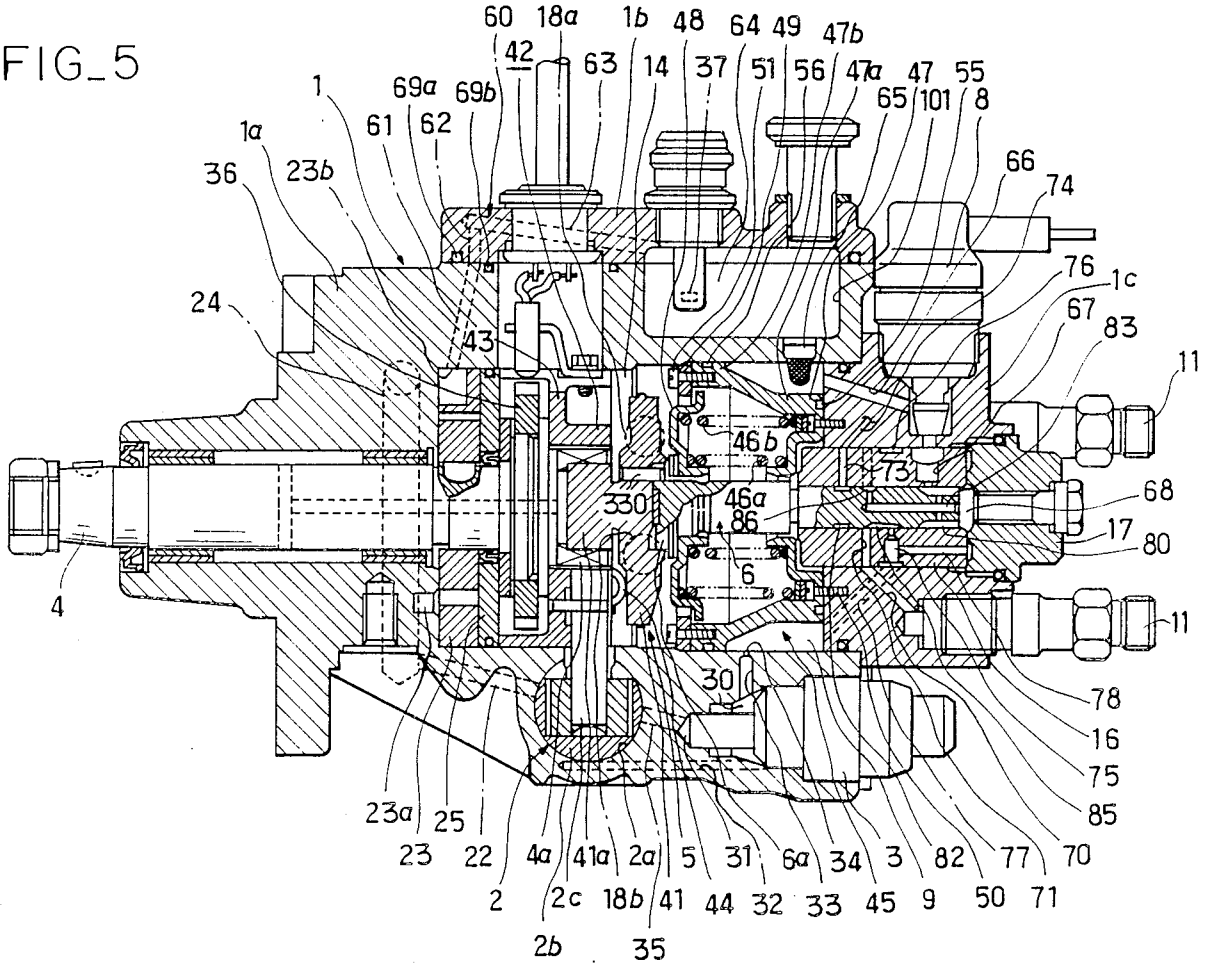
FIG. 5 is a longitudinal sectional view showing a third embodiment of the present invention.
Figure 6:
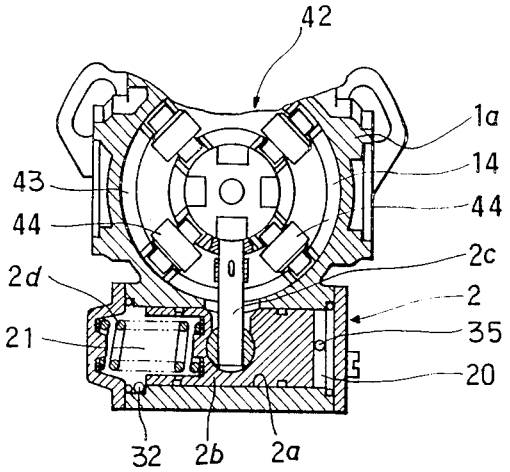
FIG. 6 is a sectional view showing the relationship between the timer and roller holder assembly in the third embodiment.

As shown in FIG. 5, the fuel supply passage 60 has a passage 61 which extends substantially radially of the body 1a and bent passages 62 and 63 which are formed in the cover 1b. The end of the passage 63 opens into a hermetic fuel reservoir 64 which is defined by the cover 1b and a recess 101 formed in the body 1a. The fuel reservoir 64 is communicated with the annular pump chamber 9 through a through-bore 65 provided with a filter which is provided in the bottom of the fuel reservoir 64. Since the fuel reservoir 64 absorbs pulsations of feed fuel, the flow of fuel from the annular pump chamber 9 to the timing control valve 3 is bettered. The path that extends from the annular pump chamber 9 to the fuel pressurizing chamber 68 is the same as in the first embodiment. The passages 61, 62, 63 and the fuel reservoir 64 are shut off from the outside and the cam chamber 14 by means of O-rings 69a and 69b so that there will be no leakage of fuel oil.

The annular pump chamber 9 is formed by making use of a spring seat 47 as being one of the parts constituting the spring assembly 45. More specifically, the spring assembly 45 comprises two spring seats 47, 48, springs 46*a*, 46*b* concentrically disposed between the spring seats 47, 48, and a retaining ring 49 rigidly secured to the spring seat 47.

The spring seat 47 is fixed by means screws 50 with an end face thereof being in contact with the end face of the distributor head 1*c* through an O-ring 55. The spring seat 47 is not flat but has a cylindrical portion 47*a* around the outer periphery thereof which is enlarged in the shape of a trumpet so that a predetermined clearance can be obtained between the same and the body 1*a*. The axial end portion 47*b* of the cylindrical portion 47*a* is formed in the shape of a right circular cylinder and is in close contact with the inner peripheral surface of the body la through an O-ring 56. The annular pump chamber 9 is formed by these arrangements.

The retaining ring 49 is a member used to assemble the spring assembly 45 and is rigidly secured to the axial end portion 47*b* of the cylindrical portion 47*a* by means of screws. Accordingly, the outer peripheral edge of the spring seat 48 is spaced away from the retaining ring 49 and the inner periphery of the spring seat 48 is retained by a large-diameter portion 6*a* at the left end of the plunger 6 through a bearing washer and an adjusting shim to transfer the resilient forces from the springs 46*a* and 46*b* to the plunger 6.

Figure 8:
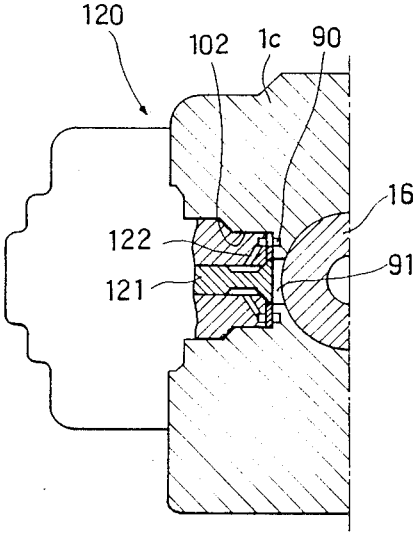
FIG. 8 is a fragmentary sectional view showing the solenoid-operated valve for spill and spill passage in the third embodiment.

The third embodiment is also different from the first embodiment in that a solenoid-operated valve 120 for spill is employed in place of the control sleeve 12*a* as a means for controlling the fuel injection quantity, as shown in FIG. 8. More specifically, the solenoid-operated valve 120 for spill has a poppet valve 121, and the distal end portion of the valve 120, including the poppet valve 121, is rigidly fitted in a recess 102 formed in a side portion of the distributor head 1*c*. An annular groove 90 is formed in the bottom of the recess 102, the groove 90 being communicated with the fuel pressurizing chamber 68 through a passage for spill (not shown) which is formed so as to extend over from the distributor head 1*c* to the plunger barrel 16.

In addition, a spill chamber 91 is formed in the central portion of the bottom of the recess 102, the chamber 91 being closed by the plunger barrel 16. The spill chamber 91 is communicated with either the annular pump chamber 9 or the feed passage 66 through a passage (not shown) which is formed in the plunger barrel 16.

In this embodiment, during the first half of the reciprocating stroke of the plunger 6, a passage hole 122 provided in the solenoid-operated valve 120 for spill is closed by the poppet valve 121 and, therefore, the fuel pressurizing chamber 68 and the fuel feed passage 60 are cut off from each other. In consequence, the fuel is pressurized in the fuel pressurizing chamber 68 and injected from the injection nozzle through one of the outlet ports 71, the discharge passage 70 and the delivery valve 11. When the solenoid unit (not shown) of the solenoid-operated valve 120 for spill is energized subsequently, the poppet valve 121 is opened, so that the fuel in the fuel pressurizing chamber 68 is released to either the annular pump chamber 9 or the feed passage 66 through the annular groove 90, the spill chamber 91 and the passage (not shown), thus completing the injection of fuel.

It should be noted that a leak stopper groove 82 is defined between the peripheral surface of the plunger 6 and the plunger barrel 16. The leak stopper groove 82 is communicated with a pipe (not shown) through leak passages 73 and 74 which are formed in the plunger barrel 16 and the distributor head 1*c*, respectively, so that the leak stopper groove 82 is communicated with the fuel tank. The fuel pressurized in the fuel pressurizing chamber 68 flows toward the cam chamber 14 through the area of sliding contact between the peripheral surface of the plunger 6 and the plunger barrel 16 although the amount of leak fuel is very small. The leak stopper groove 82 can receive and return the leak fuel to the fuel tank.

In this embodiment, further, an annular groove 76 which is communicated with the pressure equalizing port 75 is formed in the plunger barrel 16, and a pressure equalizing passage 77 one end of which is communicated with the annular groove 76 is formed in the distributor head 1*c*, the passage 77 leading to the annular pump chamber 9. Accordingly, when the plunger 6 is during a predetermined stroke and at a predetermined rotational angle position, the pressure equaliting slit 85 provides communication between the pressure equalizing port 75 and the discharge passage 70, thereby equalizing the pressure inside the discharge passage 70 with the fuel feed pressure.

It should be noted that the pressure equalizing port 75 is communicated with a leak passage 78 which opens to the end face of the plunger barrel 16. The leak passage 78 leads to the space defined at the outer peripheral side of the edge of the head plug 17 that constitutes the ceiling of the fuel pressurizing chamber 68 to return the leak fuel collecting in this space to the annular pump chamber 9 from the leak passage 78 through the pressure equalizing port 75, the annular groove 76 and the pressure equalizing passage 77.

The large-diameter portion 6*a* of the plunger 6 has a notch. A pin 330 is inserted into the notch and a hole formed in the cam disk 41, thereby enabling the plunger 6 and the cam disk 41 to rotate together in one unit. The cam disk 41 has a coupler portion 41*a* which extends axially, the coupler portion 41*a* having a non-circular cross-sectional configuration. The coupler portion 41*a* is engaged with an inner projection 4*a* of the driving shaft 4 in such a manner that the coupler portion 41*a* is axially movable relative to the inner projection 4*a*.

The structures of the timer 2 and the timing control valve 3 are the same as those in the first and second embodiments. The third embodiment is also the same as the first and second embodiments in that the low-pressure chamber 21 in the timer 2 is communicated with the suction passage 24 of the feed pump 23 through the low-pressure passage 22, that the low-pressure chamber 21 is communicated with the low-pressure hole 31 in the timing control valve 3 through the low-pressure passage 32, that the high-pressure chamber 21 is communicated with the high-pressure groove 30 in the timing control valve 3, that the high-pressure groove 30 is directly communicated with the annular pump chamber 9 through the fixed orifice 34, and that the fixed orifice 34 may have any of the forms shown in FIGS. 4*a* to 4*c*. Therefore, the same elements are denoted by the same reference numerals and description thereof is omitted.

OPERATION

Since the basic operation of the distributor type fuel injection pump has already been described, the operation and function of an improvement according to the present invention will be explained below.

In the first and second embodiments, the fuel oil in the pump chamber 9 flows into the high-pressure groove 30 in the timing control valve 36 through the passage 33 after the flow rate has been reduced through the fixed orifice 34 provided in the body la of the pump housing 1, and the fuel oil further flows from the high-pressure groove 30 to the high-pressure chamber 20 in the timer 2 through the passage 35.

When the solenoid unit 3*c* of the timing control valve 3 is not energized, the needle 3*a* is at the position for closing the valve, so that the high-pressure groove 30 and the low-pressure hole 31 are cut off from each other. Accordingly, the high-pressure chamber 20 and low-pressure chamber 21 in the timer 2 are cut off from each other.

The pressure inside the pump chamber 9 depends on the number of revolutions of the engine, that is, the delivery pressure of the feed pump 23. Thus, when the number of revolutions of the engine is low, the level of pressure inside the high-pressure chamber 20 is also low and therefore the timer piston 2*b* is pressed toward the high-pressure chamber 20 by means of the set force of the spring 2*d*. In other words, the timer piston 2*b* is positioned on the retard side. As the number of revolutions of the engine becomes so high that the pressure inside the high-pressure chamber 20 exceeds the set force of the spring 2*d*, the timer piston 2*b* moves toward the low-pressure chamber 21, thus causing the roller holder assembly 42 to rotate through the pin 2*c*. In consequence, the lift position of the disk cam 5 is advanced and the ignition lag is thereby corrected.

If, in these circumstances, the solenoid unit 3*c* of the timing control valve 3 is energized, the needle 3*a* is lifted to open the valve, thus bringing the high-pressure groove 30 into communication with the low-pressure hole 31 through the side bore 3*f*, the internal passage defined between the valve body 3*e* and the needle 3*a* and the end bore 3*g*. As a result, the pressure in the high-pressure chamber 20 of the timer 2 is leaked to the low-pressure chamber 21 through the passage 35, the low-pressure hole 31 and the low-pressure passage 32, resulting in a lowering in the pressure inside the high-pressure chamber 20.

Thus, the timer piston 2*b* is set at a position where the adjusted pressure and the force from the spring 2*d* balance with each other, and the movement of the timer piston 2*b* is transmitted to the roller holder assembly 42 through the pin 2*c*, causing the roller holder assembly 42 to rotate. Accordingly, the angular position of the roller holder assembly 42 is adjusted by ON/OFF controlling the supply of electric power to the solenoid unit 3*c* in a desired duty ratio with the electronic controller 13, thereby controlling the region in the cam profile of the cam disk 41 which is used to control the fuel injection timing, and thus realizing an injection timing which is conformable to running conditions.

Figure 9:
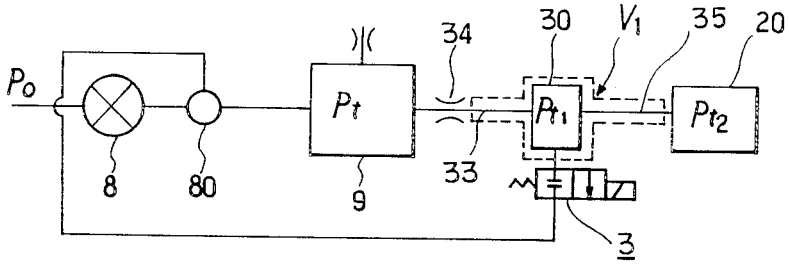
FIG. 9 is a diagram showing the timer control oil-hydraulic system in the present invention.
Figure 11:
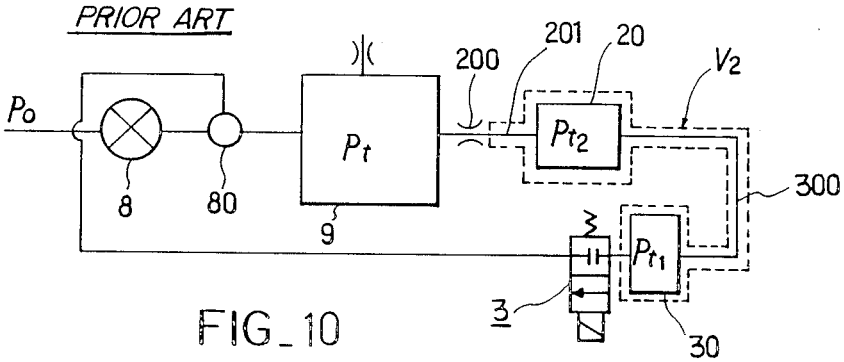
FIG 11 PRIOR ART
FIG. 11 is a diagram showing the timer control oil-hydraulic system in the conventional distributor type fuel injection pump shown in FIG. 10.
Figure 10:
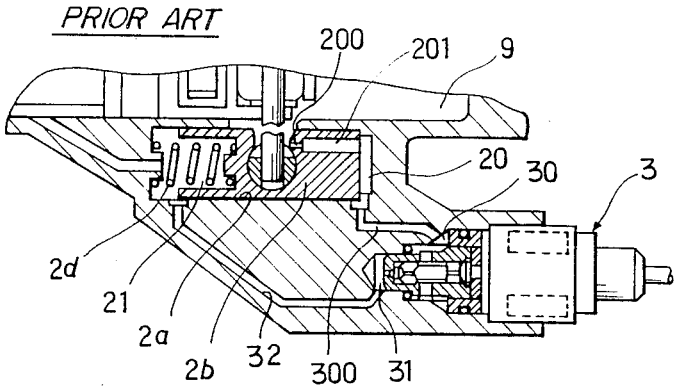
FIG 10 PRIOR ART
FIG. 10 is a fragmentary sectional view of a conventional distributor type fuel injection pump.

In such a control, the working pressure that actually activates the timer piston 2*b* is the pressure $Pt_2$ inside the high-pressure chamber 20, as has been described above. In the present invention, the oil-hydraulic path that extends from the pump chamber 9 to the high-pressure chamber 20 comprises the pump chamber 9, the fixed orifice 34 in the pump housing 1, the passage 33, the high-pressure groove 30 and the passage 35, as shown in FIG. 9. Therefore, the dead volume $V_1$ that exists between the fixed orifice 34 and the valve seat portion (the boundary between the high- and low-pressure regions) of the timing control valve 3 is considerably smaller than the dead volume $V_2$ in the conventional system shown in FIG. 11.

As a result, the amount of work required to change the level of working pressure acting on the timer piston 2*b* is reduced correspondingly. It is therefore possible to improve the responsiveness of the timer piston 2*b* and hence realize fuel injection timing control which is capable of satisfactorily exhibiting the advantages of the electronic timing control.

The above-described operation and function are completely the same also in the third embodiment except that the pump chamber 9 has an annular configuration. The operation and function that are characteristic of the third embodiment will be explained below. Specifically, a lubricating oil (engine oil) is accommodated in the lower part of the cam chamber 14. The lubricating oil is splashed by the cam disk 41 rotating at high speed, thereby lubricating the area of contact between the cam surface and each roller 7*a*. The lubricating oil also lubricates the area of sliding contact between the plunger 6 and the plunger barrel 16.

On the other hand, the fuel oil discharged from the feed pump 23 is fed to the fuel reservoir 64 through the passage 61 and the bent passages 62 and 63 and then fed to the annular pump chamber 9 through the through-bore 65 provided with a filter after the pulsation has been absorbed in the fuel reservoir 64.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A distributor type fuel injection pump comprising:

(a) a pump housing having a hollow body, a cover covering an upper opening in said body, and a distributor head closing a side opening in said body;

(b) a pump chamber formed in said pump housing;

(c) a plunger barrel rigidly secured to said distributor head in such a manner that one end of said plunger barrel faces said pump chamber, said plunger barrel having a feed passage for leading fuel from said pump chamber and a plurality of outlet ports which are axially offset from said feed passage, said outlet ports communicating with a delivery valve attached to said distributor head;

(d) a feed pump driven by a driving shaft extending through that portion of said body on the side thereof which is remote from said plunger barrel to feed fuel to said pump chamber;

(e) a plunger inserted into said plunger barrel, one end of said plunger cooperating with said plunger barrel to define a fuel pressurizing chamber, the other end of said plunger being coupled to said driving shaft in such a manner that said plunger is rotatable together with said driving shaft in one unit and also reciprocatable axially, said plunger having an outlet slit for providing communication between one of said outlet ports and said fuel pressurizing chamber during the first half of the reciprocating stroke of said plunger, and an inlet slit for providing communication between said feed passage and said fuel pressurizing chamber during the second half of said reciprocating stroke;

(f) a cam mechanism for giving axial reciprocating motion to said plunger, said cam mechanism having a disk cam rotating together with said plunger in one unit, a roller holder assembly having a plurality of rollers supporting said disk cam, and a spring assembly pressing said cam disk;

(g) a timer disposed in the lower part of said body to rotate said roller holder assembly in order to control the fuel injection timing, said timer having a cylindrical timer piston chamber and a timer piston dividing the interior of said timer piston chamber into a high-pressure chamber and a low-pressure chamber, said timer piston being coupled to said roller holder assembly through a pin:

(h) a solenoid-operated timing control valve disposed in the vicinity of said timer to cause said high-pressure chamber and said low-pressure chamber to be communicated with or cut off from each other, thereby controlling the level of pressure inside said high-pressure chamber;

(i) said low-pressure chamber in said timer communicating with a low-pressure hole in said timing control valve through a first passage;

(j) said high-pressure groove in said solenoid-operated timing control valve communicating with said high-pressure chamber through a second passage; and (k) said high-pressure groove and said pump chamber being directly connected together by a third passage through a fixed orifice located in the wall of said body, the junction of said third passage and said high-pressure groove being circumferentially offset from the junction of said second passage and said high-pressure groove.

2. A distributor type fuel injection pump according to claim 1, wherein said pump chamber is constituted by the whole internal space in said body.

3. A distributor type fuel injection pump according to claim 1, wherein said timing control valve is attached to said body, said first and second passages being bored in the bottom wall of said body, and said third passage that connects together said high-pressure groove and said pump chamber being also bored in the bottom wall of said body.

4. A distributor type fuel injection pump according to claim 1, wherein said timing control valve is attached to a block which is attached to said body, said second passage that connectes together said high-pressure chamber and said high-pressure groove in said timing control valve being bored in said block, and said third passage that connects together said high-pressure chamber, said high pressure groove and said pump chamber being formed so as to extend over from said bottom wall of said body to said block.

5. A distributor type fuel injection pump according to claim 1, wherein said pump chamber is annularly defined between the inner wall of said body, the end face of said distributor head and a spring seat constituting said plunger spring assembly, the interior of said body other than said annular pump chamber being defined as a cam chamber accommodating a lubricating oil, and said annular pump chamber being fed with fuel from said feed pump through a fuel feed passage which bypasses said cam chamber.

6. A distributor type fuel injection pump according to claim 5, wherein said fuel feed passage has a radial passage extending radially of said body so as to lead to a discharge port of said feed pump and a pair of first and second bent passages bored in said cover, one end of said second bent passage leading to a fuel reservoir defined between said cover and a recess provided in the upper part of said body, said fuel reservoir communicating with said annular pump chamber through a bore provided with a filter.

7. A distributor type fuel injection pump according to claim 5, wherein said spring seat is rigidly secured at one end thereof to an end face of said distributor head, said spring seat having a cylindrical portion expanding in a trumpet shape which is formed on the outer periphery thereof and an enlarged end portion extending from the end of said cylindrical portion so as to be in contact with the inner wall of said body, said spring seat being oil-tightly sealed at the surfaces of contact with said distributor head and the inner wall of said body by means of O-rings, thereby forming said annular pump chamber around said cylindrical portion.

8. A distributor type fuel injection pump according to any one of claims 1 to 7, wherein said fixed orifice is constituted by a bore having a small diameter which is provided directly in the bottom wall of said body.

9. A distributor type fuel injection pump according to any one of claims 1 to 7, wherein said fixed orifice is formed by rigidly fitting a chip having a small-diameter bore into a stepped hole formed in the bottom wall of said body.

10. A distributor type fuel injection pump according to any one of claims 1 to 7, wherein a stepped hole is formed in the bottom wall of said body and subsequently a small-diameter bore serving as said fixed orifice is formed directly in the bottom surface of said stepped hole and then a filter is fitted into said stepped hole.

* * * * *